US005222564A

United States Patent [19]

Bonca

[11] Patent Number: 5,222,564

[45] Date of Patent: Jun. 29, 1993

[54] DRILLING UNIT

[75] Inventor: Aron Bonca, Scarborough, Canada

[73] Assignee: Boa Drilling Equipment Inc., Scarborough, Canada

[21] Appl. No.: 788,528

[22] Filed: Nov. 6, 1991

[51] Int. Cl.[5] ..... E21B 7/02

[52] U.S. Cl. ..... 173/189; 173/27; 173/28; 173/39

[58] Field of Search ..... 173/27, 28, 184, 185, 173/189, 213, 39

[56] References Cited

U.S. PATENT DOCUMENTS

| | | | |
|---|---|---|---|
| 3,708,024 | 1/1973 | Back | 173/189 |
| 3,732,935 | 5/1973 | Gibson | 173/28 |
| 3,917,005 | 11/1975 | Cannon et al. | 173/189 |
| 4,303,130 | 12/1981 | Bonca . | |
| 5,082,068 | 1/1992 | Cornell | 173/39 |

OTHER PUBLICATIONS

Service Manual, 35D/40D and 55D/60D High Visibility Worldmast, Cascade Corporation 1990.

*Primary Examiner*—Douglas D. Watts
*Assistant Examiner*—Allan M. Schrock

[57] ABSTRACT

A drilling machine includes a boom assembly which has two straight parallel longitudinal beams of extruded steel, each of a section defining straight parallel inwardly and outwardly facing ways, a drilling head in a carriage and rollers guiding said carriage for linear movement of said drilling head parallel to said inwardly facing ways, two straight parallel longitudinal boom extension members and rollers guiding said boom extension members in said outwardly facing ways, and cross members linking said boom extension members to form a frame, plate braces linking said beams in longitudinally spaced planes perpendicular to the axes of the beams, said plate braces being apertured to provide clearance for assembly and normal movement of said carriage, said drilling head, and drill tubes passing through said drilling head, and further longitudinal members linking said plate braces to form a cradle of the boom assembly, said cradle having brackets for pivotally supporting the boom assembly on a base. The carriage for the drilling head can be actuated by a hydraulic cylinder forming a single double ended piston rod, through chains anchored to the cradle and to the carriage and passing over sheaves attached to opposite ends of the piston rod.

7 Claims, 3 Drawing Sheets

DRILLING UNIT

BACKGROUND OF THE INVENTION

1. Field of the Invention

This invention relates to drilling machines used for drilling bores into terrain, especially but not exclusively for investigating the terrain and recovering samples.

2. Review of the Art

An example of such a machine is described in U.S. Pat. No. 4,303,130 of A. Bonca. Primary features of machines of this type are the provision of a drilling boom, and means to position and support this boom in alignment with a bore to be drilled. The drilling boom supports a drilling head for longitudinal movement along the axis of the boom, the drilling head including a motor, usually hydraulic, for rotating a drilling tube which passes through the head. The boom has an extension supporting tackle for handling extension tubes as these are added to the end of a string of drill tubes as drilling progresses, or as tubes forming part of the string are withdrawn from the bore. The boom is supported on a base mounted on a suitable support or vehicle, which in the case of the above patent is an all terrain vehicle.

Booms for such drills are typically fabricated by welding from steel sections, with machined ways for guiding the drill head, which must be maintained in good alignment with the boom despite the transmission through it of considerable torsional, longitudinal and lateral forces. Such booms have as a result been expensive to fabricate, difficult to maintain in alignment, massive, and bulky, particularly in view of the boom extension. Although the boom extension can in some cases be dismantled for transportation of the unit, time is then lost in reassembling the boom extension before the drill can be used, and it may be difficult or impossible to deploy the drill in confined spaces.

SUMMARY OF THE INVENTION

It is an object of the present invention to provide an improved boom construction for such drilling units which combines strength, economy of construction and maintenance, and compactness, suiting it to use in self-contained drill units which can be mounted on any suitable carrier such as on and off road vehicles, skids, barges and so on.

I have now found that by adapting certain constructional techniques long used in the construction of the masts of fork lift trucks, it is possible to produce a drill boom structure of compact and economical construction that provides and maintains excellent alignment, and in which the boom extension can be made readily retractable for transit. An exemplary fork lift truck mast structure is described in detail in the Service Manual for the 35D/40D and 55D/60D High Visibility WORLD-MAST (Trademark) Full Free Lift 3-Stage Mast published by Cascade Corporation. Such masts are commonly based upon the use of extruded steel longitudinal sections produced for such applications, the dimensional accuracy and straightness of such extrusions being such that they can provide channels for guiding rollers supporting adjacent structures without the necessity for machining.

According to the invention, a drilling machine includes a boom assembly which has two straight parallel longitudinal beams of extruded steel each of a section defining straight parallel inwardly and outwardly facing channels, a drilling head in a carriage and rollers guiding said carriage for linear movement of said drilling head parallel to said inwardly facing channels, two straight parallel longitudinal boom extension members and rollers guiding said boom extension members in said outwardly facing channels, and cross members linking said boom extension members to form a frame, plate braces linking said beams in longitudinally spaced planes perpendicular to the axes of the beams, said plate braces being apertured to provide clearance for assembly and normal movement of said carriage, said drilling head, and drill tubes passing through said drilling head, and further longitudinal members linking said plate braces to form a cradle of the boom assembly, said cradle having brackets for pivotally supporting the boom assembly on a base.

With such a structure, the boom extension may be telescoped into a withdrawn position relative to the boom proper formed by the longitudinal beams, which provide ways both for the drill head carriage and the boom extension to provide a strong yet compact structure. Whilst the feature of guiding the boom extension members in external ways could be omitted, the compactness of the unit, and the ease of setting it up in confined spaces, would be prejudiced if a conventional boom extension were utilized.

The carriage for the drilling head can be actuated by a hydraulic cylinder forming a single double ended piston rod, through chains anchored to the cradle and to the carriage and passing over sheaves attached to opposite ends of the piston rod.

SHORT DESCRIPTION OF THE DRAWINGS

Figure 5:
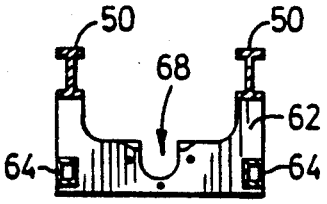
Figure 6:
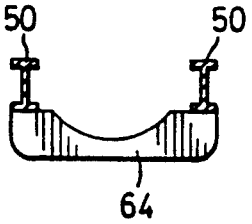
Figure 9:
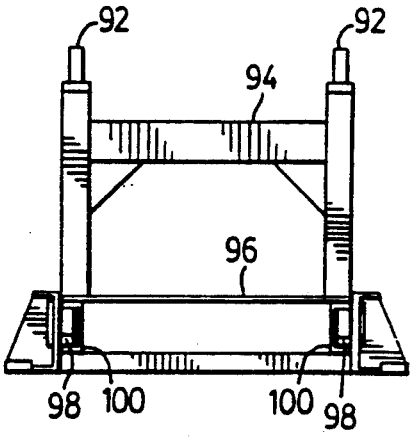
Figure 7:
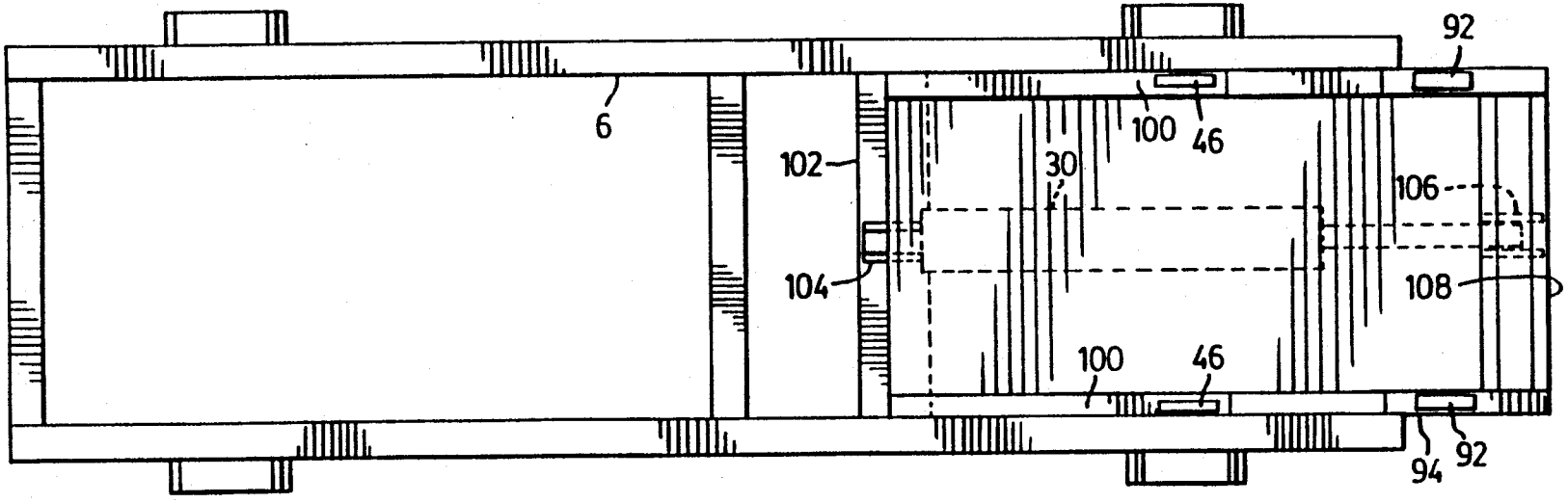
Figure 8:
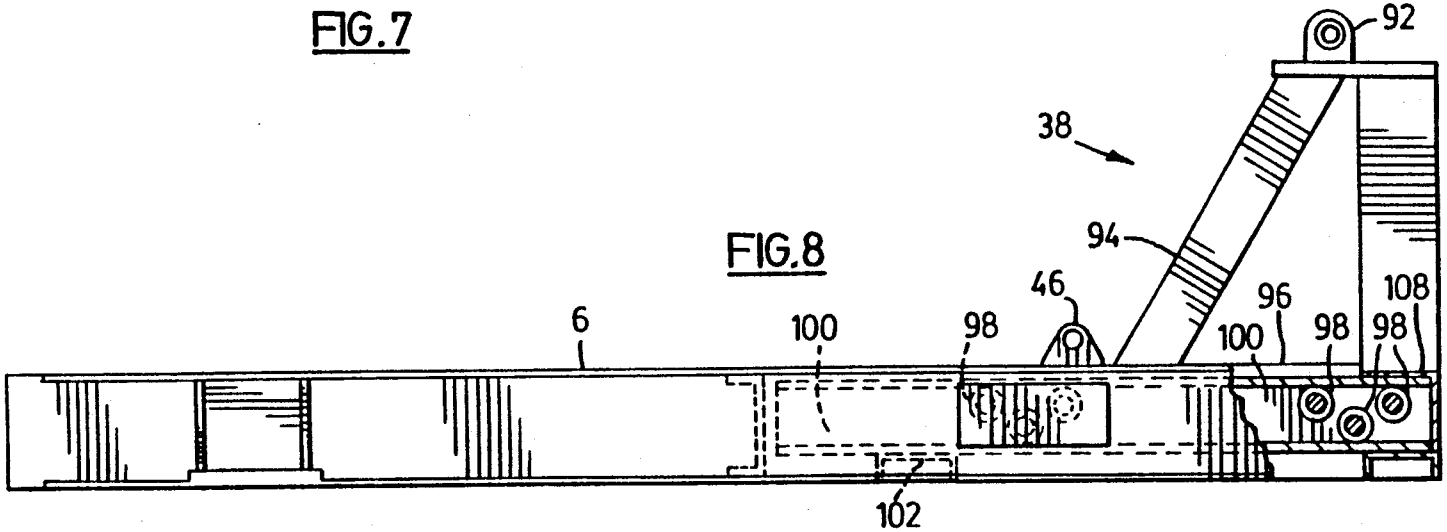

FIGS. 5 and 6 are sections through the boom on lines 5—5 and 6—6 respectively; and FIGS. 7, 8 and 9 are plan, side elevational and end elevational views of a base portion of the drill unit.

DESCRIPTION OF THE PREFERRED EMBODIMENT

Figures 1, 3, 4:
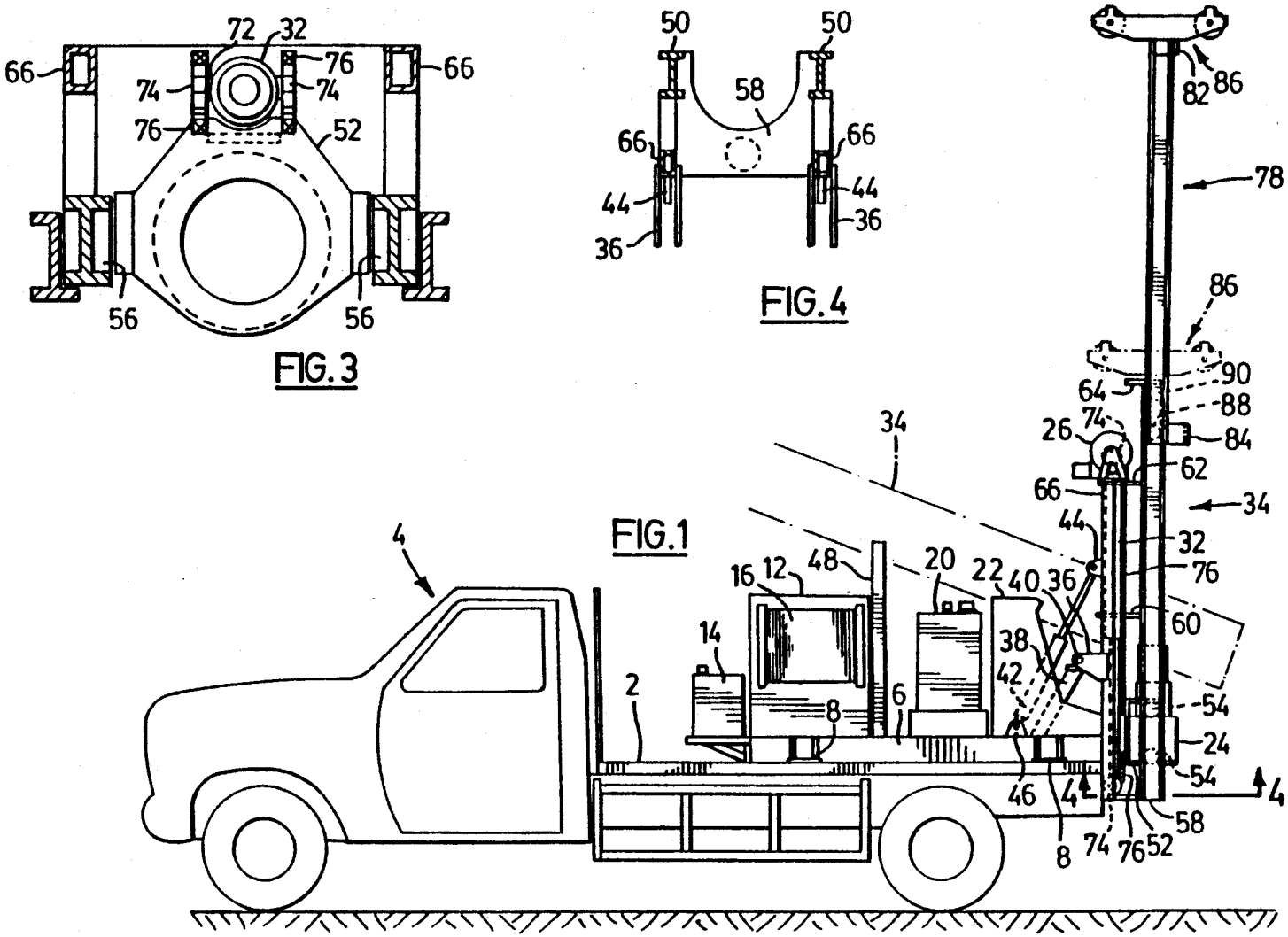
FIG. 1 is a side elevation of a drill unit in accordance with the invention, mounted on a truck.
FIG. 3 is a cross section on the line 3—3 through the boom assembly of the unit, also showing the carriage for the drill head.
FIG. 4 is a bottom view of the boom, with the carriage and drive mechanism for the carriage omitted for clarity.
Figure 2:
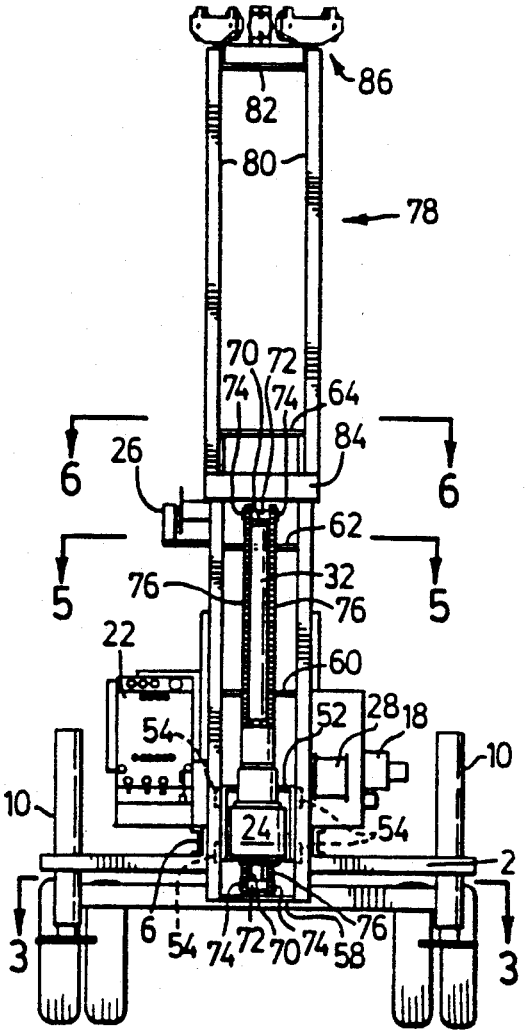
FIG. 2 is a rear elevation of the same unit.

Referring to FIGS. 1 and 2, a drill unit in accordance with the invention is shown mounted on the bed 2 of a truck 4 by means of a base frame 6, described further below with reference to FIGS. 7 to 9. It should be understood that the unit is self-contained, and may be mounted equally well on a skid, barge, fixed structure, or other type of vehicle such as an all-terrain vehicle without any adaption other than that necessary to provide a secure support for the frame 6 and means for securing its mountings 8. In the case of a vehicle, jacks 10 (shown only in FIG. 2) should be provided to provide additional support for the drilling unit during use of the latter.

Mounted on the frame 6 are an internal combustion engine 12, a fuel tank 14 and oil cooler 16 for the engine, a hydrostatic pump 18 driven by the engine and a hydraulic reservoir 20, all of which may be of conventional design. A control panel 22 carries controls for the various hydraulic functions of the drilling unit, which of themselves form no part of the present invention and are generally as described in prior U.S. Pat. No. 4,303,130, already mentioned above, except that it is not contemplated that the support vehicle will be hydrostatically operated with power from the same engine. Further hydrostatically operated equipment is provided, generally as described in the prior patent, including a drilling head 24 incorporating a gearbox, transmission and hydraulic motor, a wireline winch 26, a cathead 28, a drill head control cylinder 32, tilt cylinders 42 and a base control cylinder 30. Whilst the control and basic functions of the latter two items are conventional, their actual implementation are unique to the present invention and are described further below.

Also mount ed on a movable frame 38 supported in the base frame, as further described with reference to FIGS. 7 to 9 is a drill boom assembly 34, mounted by brackets 36 and pivots 40. The assembly 34 may be tilted about the pivots 40 by the cylinders 42 which are connected between brackets 46 on the frame 38 and brackets 44 on the assembly 34, between the upright position shown in FIGS. 1 and 2 (which is the usual position for drilling although inclined drilling will sometimes be required), and an inclined transit position shown in broken lines, in which position it rests on a support 48.

The construction of the drill boom assembly is based upon two parallel longitudinal beams 50, which are I-sections of extruded steel as produced for the fabrication of masts for fork-lift trucks; suitable sections are obtainable from Cascade Corporation. It has been found that the dimensional tolerances and straightness of such beams .is such that they will without machining provide guide channels for rollers 54 of a carriage 52 supporting the drill head, which provide guidance for and sustain forces from the latter when incorporated into a cradle as described below. The rollers 54 of the carriage 52 are guided by inward facing channels 56 formed by the I-beams, which beams are connected by plate braces 58 (FIG. 4), 60, 62 (FIG. 5) and 64 (FIG. 6) welded to the beams (See also FIG. 3). The braces 58, 60 and 62 are further connected by box-section beams 66 to form a rigid cradle, the brackets 36 and 44 being welded to the beams 66, thus minimizing the application of bending stresses to the I-beams 50. Each of the plate braces is cut away to provide clearance for the drill head and associated drill tubes as it moves longitudinally of the I-beams on the rollers 54, whilst the plate braces 60 and 62 are further cut away to provide clearance for the carriage 52 as it moves past them.

The braces 60 and 62 are still further provided with cut-outs 68 to receive the ends of the hydraulic cylinder 32, flanges on which are bolted to these braces. The piston in the cylinder, which is double acting, has a double ended piston rod 70, each end of the rod having a yoke 72 carrying chain sheaves 74. Chains 76 have their one ends anchored to the carriage 52, pass in oppositely directed loops over the sprockets 74 at the upper end of the piston rod and the sprockets 74 at the lower end of the piston rod 70, and are also anchored at their other ends to the carriage 52. Since the cylinder 32 is anchored to the cradle, and extends substantially parallel to the longitudinal axes of the beams, movement of the piston rod 70 in either direction results in a multiplied movement, in the same direction, of the carriage 52, the total movement range of the carriage being twice the stroke of the piston rod 70 relative to the cylinder 32. Since the cylinder is double acting, the drill head is moved positively in each direction. This is in contrast to actuation arrangements for fork lift truck masts, in which gravity can be relied upon for downward movements of a load platform.

A retractable boom extension 78 is formed by further extruded steel I-beams 80 linked into a frame by welded upper and lower cross members 82 and 84. The cross member 84 is bowed rearwardly to provide clearance for the drill head 24 when the boom extension is retracted so that a sheave block assembly 86, used for handling drill tubes and components, assumes the position shown in broken lines in FIG. 1. The boom extension is guided by the engagement of rollers 88 mounted at the bottoms of the beams 80 and engaging channels formed by the outer surfaces of the beams 50, and the engagement of rollers 90 mounted at the tops of the beams 50 and engaging channels formed by the inner surfaces of the beam 80. The extension 78 may be locked in the extended position shown by means of locking pins (not shown).

Referring now to FIGS. 7-9, bearing blocks 92 for the pivots 40 are supported by a trestle 94 on a subframe 96, the sidemembers 100 of which are extruded steel C-section beams, again of the type used in fork lift truck masts. The C-section beams present channels to spaced clusters of three rollers 98 mounted on longitudinal members of the frame 6. The cylinder 30 acts between a bracket 104 on a cross-member 102 of the frame 6, and a bracket 106 on a cross-member 108 of the subframe 96 so that the subframe may be moved rearwardly from the position shown in FIGS. 7 and 8 so as to overhang the rear of the vehicle.

In use, the vehicle is driven to a drilling site with the boom 34 in the inclined position shown in broken lines. At the site, the engine 12 is started to provide hydraulic power, the boom 34 is moved to the vertical (or other desired drilling angle), and then positioned exactly over a desired entry point by extension of the cylinder 30. The jacks 10 are extended to prevent suspension movement or tipping of the rear of the vehicle. The boom extension 78 is raised and locked in position. One way in which this may be achieved is temporarily to lock the cross piece 84 to the carriage 52 of the drill head, and then use the cylinder 32 to raise the drill head and the boom extension with it, at which point the boom extension may be locked to the top of the boom and released from the carriage 52. The drill may now be operated in a conventional manner.

Both in the case of movements of the drill base under control of the cylinder 30, and of the drill head under control of the cylinder 32, essentially friction free movement is obtained through the interaction of rollers and the accurately dimensioned channels provided by the extruded steel beams 50 and 100. In the case of the boom 34, the trueness of the ways formed by the extruded beams creates ideal running surfaces both for the boom extension 78, and, more importantly, the carriage 52 of the drill head 24. The drill head carriage rides on the rollers 54 formed by steel rimmed roller bearings mounted on stub shafts to provide an assembly which is substantially free from wear or loosening even after prolonged exposure to high drilling forces. Likewise, the rails 100 of base subframe can move freely on the rollers in a manner which is not subject to the wear or loosening which has plagued prior drill bases. No machining of the ways formed by the beams 50, 80 and 100 is required, whilst the rollers are obtainable as manufactured units which are ready to bolt into place, and readily replaced if necessary. The replacement of sliding bearing surfaces by rolling contact between parts reduces both friction and wear, and eliminates the need for machined bearing surfaces on the principal boom and base components.

I claim:

1. A drilling machine having a drilling head mounted in a carriage for longitudinal movement along a rotational axis of the drilling head, the carriage having plural guide rollers mounted outboard thereof for rotation about longitudinal spaced parallel axes perpendicular to a rotational axis of the drilling head; a boom assembly for supporting the carriage, whose load bearing structural components consist of two laterally spaced straight parallel longitudinal beams each formed by a single unitary component of a uniform section defining at least a straight parallel inwardly facing channel, said rollers mounted on the carriage engaging walls of said channels and guiding said carriage for linear movement parallel to longitudinal axes of said beams and the rotational axis of the drilling head, the axes of said rollers being parallel to a common plane of the longitudinal axes of the beams, plate braces connected to said beams and extending to one side of a common plane of said beams in longitudinally spaced planes perpendicular to the longitudinal axis of the beams, said plate braces being apertured to provide clearance for longitudinal movement of the carriage and the drilling head, and further longitudinal members linking peripheries of at least certain of the plate braces to form a cradle; and a base, said cradle having brackets pivotally mounting said boom assembly on the base.

2. The drilling machine of claim 1, wherein each longitudinal beam is formed by a single steel extrusion.

3. A drilling machine having a drilling head mounted in a carriage for longitudinal movement along a rotational axis of the drilling head, the carriage having plural guide rollers mounted outboard thereof for rotation about longitudinally spaced parallel axes perpendicular to a rotational axis of the drilling head; a boom assembly for supporting the carriage, whose structural components consist essentially of two laterally spaced straight parallel longitudinal beams each formed by a single steel extrusion, and each of a uniform section defining at least a straight parallel inwardly facing channel, said rollers mounted on the carriage engaging walls of said channels and guiding said carriage for linear movement parallel to longitudinal axes of said beams and the rotational axis of the drilling head, the axes of said rollers being parallel to a common plane of the longitudinal axis of the beams, plate braces connected to said beams and extending to one side of a common plane of said beams in longitudinally spaced planes perpendicular to the longitudinal axes of the beams, said plate braces being apertured to provide clearance for longitudinal movement of the carriage and the drilling head, and further longitudinal members linking peripheries of at least certain of the plate braces to form a cradle; and a base, said cradle having brackets pivotally mounting said boom assembly on the base, wherein the longitudinal beams further define outwardly facing channels, and the machine further comprises two straight parallel boom extension members, rollers guiding said boom extension members in said outwardly facing channels, and cross members linking said extension members to form a retractable boom extension.

4. The drilling machine of claim 3, wherein the boom extension members are also extruded steel beams of uniform section and defining further inwardly facing channels, rollers mounted on an upper end of the beams of the boom assembly engaging said further inwardly facing channels, and rollers mounted on lower ends of the boom extension members engaging the outwardly facing channels of the beams of the boom assembly.

5. The drilling machine f claim 3, wherein a double ended, double acting hydraulic cylinder is rigidly mounted in said cradle extending parallel to said longitudinal axes, and chain sheaves are mounted at opposite ends of a piston rod of said cylinder engaging oppositely extending loops of chains, the ends of which chains are secured to said carriage, whereby to provide multiplied movement of said carriage longitudinally of the assembly upon movement of the piston rod.

6. The drilling machine of claim 3, wherein the base includes a subframe to which the boom assembly is pivotally mounted, the subframe including unitary horizontal side beams of extruded steel defining outwardly facing channels, and a main frame having longitudinal members mounting rollers engaging the channels of said side beams, whereby the horizontal location of said boom assembly relative to the main frame of the base can be adjusted.

7. The drilling machine of claim 6, wherein the main frame of the base further includes an internal combustion engine, a hydrostatic pump connected to said engine, and a control console controlling the supply of hydrostatic pressure to a hydraulic motor in said drill head, and to hydraulic cylinders respectively controlling the positioning of the drill head carriage longitudinally of the boom assembly, and the angle and horizontal position of the boom assembly, to form a self-contained unit.

* * * * *